US005858630A

United States Patent [19]

Poncelet et al.

[11] Patent Number: 5,858,630

[45] Date of Patent: Jan. 12, 1999

[54] PROCESS FOR TREATING A PHOTOGRAPHIC BATH CONTAINING ORGANIC CONTAMINANTS

[75] Inventors: Olivier J. Poncelet, Tassigny; Jeannine Rigola, Morinet; Danielle M. Wettling, du Burg, all of France

[73] Assignee: Eastman Kodak Company, Rochester, N.Y.

[21] Appl. No.: 919,912

[22] Filed: Aug. 28, 1997

[30] Foreign Application Priority Data

Aug. 29, 1996 [FR] France ..... 96 10741

[51] Int. Cl.[6] ..... G03C 5/395

[52] U.S. Cl. ..... 430/398; 430/399; 430/400

[58] Field of Search ..... 430/398, 399, 430/400

[56] References Cited

U.S. PATENT DOCUMENTS

| | | | |
|---|---|---|---|
| 4,227,681 | 10/1980 | Golden | 266/170 |
| 4,988,448 | 1/1991 | Woog | 210/665 |
| 5,015,560 | 5/1991 | Koboshi et al. | 430/398 |
| 5,210,009 | 5/1993 | McGuckin et al. | 430/399 |
| 5,449,553 | 9/1995 | Griffith | 428/332 |

OTHER PUBLICATIONS

Research Disclosure, vol. 148, No. 56, Aout 1976, Havant GB, p. 45, RWDillion et al., "Coating Photographic Processing Equipment to Reduce Undesirable Chemical Growth".

*Primary Examiner*—Hoa Van Le
*Attorney, Agent, or Firm*—John R. Everett

[57] ABSTRACT

The present invention concerns a process for treating photographic baths containing organic contaminants and a device for implementing this method.

The process for treating a photographic bath containing contaminants comprises the step of putting the photographic bath in contact with a photographically inert material, resistant to a high pH and having a lipophilic surface.

This method affords an improvement in the processing of photographic products.

8 Claims, 1 Drawing Sheet

PROCESS FOR TREATING A PHOTOGRAPHIC BATH CONTAINING ORGANIC CONTAMINANTS

FIELD OF THE INVENTION

The present invention concerns a method for treating photographic baths containing organic contaminants and a device for implementing this method.

PRIOR ART

Conventionally, silver halide photographic products, after exposure, are developed in different photographic processing baths. The processing of black and white photographic products generally comprises a black and white development step, a fixing step and a washing step. The processing of color photographic products comprises a chromogenic development step, a bleaching step, a fixing step and a washing step. In the case of reversible photographic products, the processing of the photographic product comprises an additional image reversal step.

During the processing of these photographic products, the composition of the processing baths changes. In particular, the photographic baths become loaded with chemical substances (gelatin, latex, polymers, surfactant, etc) coming from the photographic products, which contaminates the baths and reduces their efficiency. The presence of these contaminants in the photographic processing baths results in a variation in the sensitometry of the photographic products, and dirtying of the product and the processing machine. This phenomenon is all the more significant in so far as the photographic products are generally processed in automatic processing machines. These machines, which enable photographic products to be developed rapidly, are also more rapidly contaminated. In particular, there appear in the photographic processing baths of these automatic machines organic contaminants (tars) which originate from the photographic products and which are deposited on the photographic product in the course of the processing, which gives rise to a fouling of the machine. The presence of these tars requires significant replenishment of these processing baths, a more rapid replacement of the baths and, in extreme cases, several steps of washing the photographic products.

It is known from the art that this drawback can be remedied by adding to the baths, during the processing, surfactants which dissolve the tars present. However, the addition of these agents in a significant quantity modifies the stability and efficiency of the processing baths.

It is also known that the structure of the photographic products can be modified by adding a top layer, the role of which is to protect the layers of silver halide emulsions and thus to obtain photographic products which are relatively insensitive to the contaminants contained in the baths.

The aim of the present invention is to remedy the problem relating to the presence of the tars in the photographic processing baths. This is because it is desirable to develop a method which makes it possible to eliminate these tars economically and rapidly, without impairing the sensitometric properties of the photographic products being processed and without modifying the stability or efficiency of the photographic processing baths.

Another aim of the invention is to reduce the fouling of the automatic processing machines and thus to procure longer intervals between maintenance operations on these machines.

SUMMARY OF THE INVENTION

These aims and others are achieved by the present invention, which concerns a process for treating photographic baths containing organic contaminants which comprises bringing the photographic bath in contact with a photographically inert material which is resistant to a high pH and has a lipophilic surface.

DETAILED DESCRIPTION OF THE INVENTION

Figure 1:
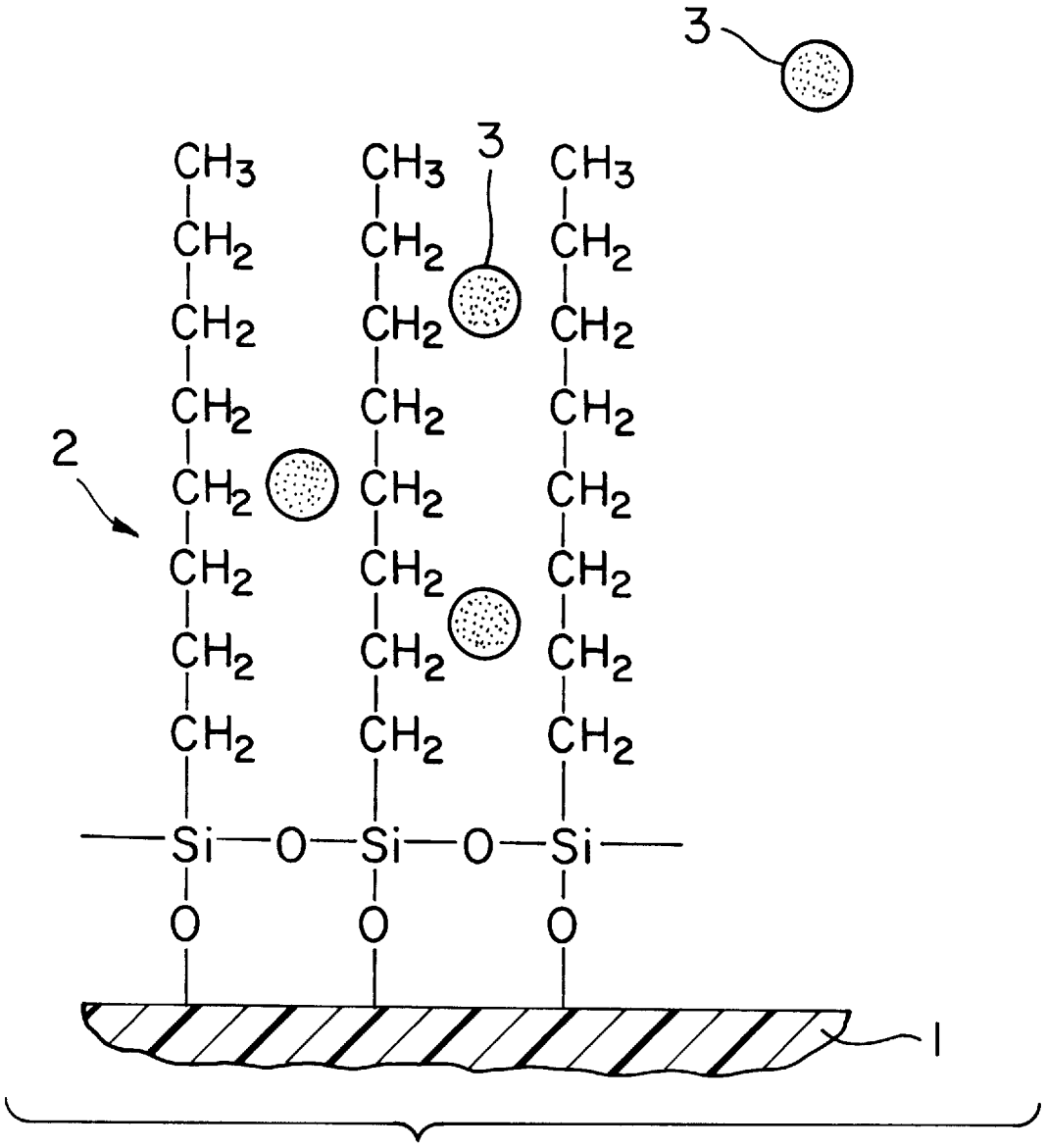
Fig. 1 shows the structure and use of the material with a lipophilic surface in Example 1, which illustrate the invention.

In the context of the invention, the lipophilic surface of the material is a surface capable of dissolving organic compounds. When the material with a lipophilic surface is in contact with the photographic processing bath containing organic contaminants, the contaminants are trapped on the material, as is shown in FIG. 1.

After use, the material with a lipophilic surface can be washed with a solvent for the contaminants and reused.

According to a particular embodiment, the material with a lipophilic surface comprises a support covered with a lipophilic polymer layer.

According to the invention, the support can be a porous support on which the entire specific surface is or has been rendered lipophilic. It is advantageous to use porous supports with large pores in order to increase the efficiency of the material.

According to a preferred embodiment, the layer is grafted onto the support. In this case, the support must have on its surface active groups which will participate in the grafting of the lipophilic layer onto the support.

When the chosen support does not inherently have active groups on the surface, it is possible to create such groups by chemical treatment of the support, for example by treating the support with a base or acid. It is also possible to treat the support with a silicon and aluminum halide.

These active groups can be acid or hydroxyl groups, preferably hydroxyl groups. In order to graft the lipophilic layer onto the support, the support with active groups on the surface is put in contact with a film-forming compound. The active groups on the support will react with the film-forming compound and thus graft the layer onto the support.

According to one embodiment of the invention, the grafting of the layer onto the support is implemented by the technique of "self-assembly", that is to say the property developed by certain chemical compounds to self-assemble when they react on a surface. This technique was described in the article "Formation and structure of self-assembled Monolayers" by Abraham Ulman, Chem. Rev. 1996,96, 1553–1554.

A support can be organic and/or inorganic. It should preferably be stable in an alkaline medium. The inorganic supports which can be used are for example clays, pumice stone, hydrotalcite, Imogolite, phyllosilicates, vermiculite, glass, metals, etc.

The organic supports which can be used are polyethylene, polyvinyl chloride, cellulose, etc.

These supports can be in various forms, for example in the form of films, particles, porous materials, plane surfaces, etc.

According to one embodiment of the invention, the film-forming compound is chosen from amongst alkylalkoxysilanes, alkylhalogenosilanes, alkylphosphonic acids, alkylphosphinic acids, alkylphosphinous acids, phosphoric acid mono or diester, or a mixture of these compounds.

According to one embodiment, the film-forming compound comprises at least one alkyl radical having at least 3 carbon atoms.

According to a particular embodiment, the film-forming compound is an alkylchlorosilane in which at least one of the alkyl groups comprises at least 3 carbon atoms. According to another preferred embodiment, at least one of the alkyl groups comprises at least 8 carbon atoms.

The alkylalkoxysilanes which are useful in the context of the invention are for example trimethoxypropysilane, triethoxypropylsilane, triethoxyoctylsilane or diethoxydipropylsilane. The alkylhalogenosilanes which can be used are for example propyltrichlorosilane, dipropyldichlorosilane, dibutyldichlorosilane, propylbutyldichlorosilane, methylbutyldichlorosilane, butyltrichlorosilane, pentyltrichlorosilane, dipentyldichlorosilane, hexyltrichlorosilane, octyltrichlorosilane, nonyldichlorosilane, dodecyltrichlorosilane, etc. The alkylphosphonic acids are for example methylphosphonic acid, octylphosphonic acid, dodecylphosphonic acid etc. The alkylphosphinic acids are for example dipropylphosphinic acid, dioctylphosphinic acid, butylpropylphosphinic acid, etc. The alkylphosphinous acids are for example butylphosphinous acid, octylphosphinous acid, decylphospinous acid, etc.

When silane film-forming compounds as described previously are used, the lipophilic layer is obtained from a solution of silane in an aprotic anhydrous solvent. This solution is put in contact with the "active" support in the presence of water. By hydrolysis, an Si-O bond is formed between the support and the silane, which immediately grafts the silane onto the support. The homogeneity of the layer is obtained by means of -Si-O-Si- bonds between the silane molecules, as shown in FIG. 1.

In this way a material is obtained with a lipophilic surface, which is mechanically and chemically very strong, and which will trap the tars formed by the organic contaminants originating from the photographic product being processed, such as residues of plasticizers, latex, surfactants, lubricants, organic contaminants of the treatment bath, for example the bath oxidation products, bactericides, detergents and any other compound insoluble in the water present in the baths.

The present invention also concerns a device for treating a photographic processing bath containing contaminants which comprises a receptacle containing a photographic processing bath containing organic contaminants and a material with a lipophilic surface.

According to one particular embodiment, the material constitutes one or more walls of the receptacle.

According to another embodiment, the material is removably fixed to at least one of the walls of the receptacle. In the device of the invention, the lipophilic material can be in the form of particles. In this case, the particles can be contained in packets of the "teabag" type or cartridges.

It is possible to use such a device in any processing bath and in any processing machine.

The present invention is described in detail in the following examples.

EXAMPLES

Example 1

A homogeneous solution was prepared by mixing 3 ml of octyltrichlorosilane (manufactured by Aldrich™, purity 97°) in 120 ml of anhydrous tetrahydrofuran. A plane polyethylene support was immersed in this mixture. The support was removed from the solution. It was thus obtained a solution layer on the support which was hydrolyzed through the moisture in the air. A lipophilic layer was thus formed. The material obtained was rinsed with osmosed water until a washing water with a pH of 7 was obtained.

A material was obtained comprising a polyethylene support (1) covered with a monolayer of polyalkylsiloxane (2) having the structure depicted in FIG. 1.

The material thus obtained was placed in a processing tank of a processing machine in which a KODAK™ ECP™ (EASTMAN COLOR POSITIVE) film was developed with KODAK™ ECP2B™ processing, which comprises a chromogenic development step, a bleaching/fixing step and a washing step.

During the processing of the film, tars appear in the development bath which have a tendency to be adsorbed on the film and on the belts of the automatic processing machine.

When the lipophilic material previously obtained was placed in this tank the tars were trapped in the material.

As FIG. 1 shows, the tars (3), which are insoluble in water, have an affinity for the lipophilic layer, which by virtue of its structure will trap the tars. The alkyl substituent of the silane makes it possible not only to trap the tars but also to protect the point of grafting of the layer on the support.

Example 2

A homogeneous solution was prepared by mixing 3 ml of octyltrichlorosilane (manufactured by Aldrich™, purity 97°) in 120 ml of anhydrous tetrahydrofuran. Pumice stone was immersed in this mixture. After 5 minutes, the pumice stone was removed from the solution. A layer of lipophilic polyalkylsiloxane was thus formed by hydrolysis over the entire specific surface area of the pumice stone. The pumice stone was then rinsed with osmosed water until a washing water with a pH of 7 was obtained.

This pumice stone was used as described above. The tars formed during processing were trapped as before on the lipophilic surface.

Example 3

The same operation as in Example 1 was performed, using a glass plate. The glass plate, covered with the lipophilic layer, enables the tars which appear during the photographic processing to be trapped effectively.

Example 4

In this example, 25 g of pumice stone treated according to the method of Example 2 was placed in 5 liters of KODAK ECP2B™ chromogenic processing bath, with the following composition:

| | |
|---|---|
| Kodak Anti cal No 4 | 1.0 ml |
| Sodium sulfite | 4.35 g |
| KODAK ™ CD2 ™ chromogenic development agent | 2.95 g |
| Sodium carbonate | 17.1 g |
| Sodium bromide | 1.72 g |
| Sulfuric acid (7.0N) | 0.62 ml |
| Water for obtaining 1 liter of developer pH (27° C.) | 10.53 |

A KODAK ECP™ film was developed in the seasoned chromogenic bath after leaving the treated pumice stones to stay in this same bath for 20 days. For each film the minimum density, the speed and the contrast were measured. The seasoned chromogenic bath and the bath after the 20 days of maceration were also analyzed.

The results of the chemical analyses (Table 1) show that the chemical composition of the bath did not vary. The presence of the material with a lipophilic surface does not change the stability of the bath. In addition the material is perfectly resistant to a basic pH.

Table 2 sets out the variations in minimum density, speed and contrast when the film was treated in the seasoned bath and in the same bath after staying of the pumice stone. Negligible sensitometric variations were observed. These sensitometric results show that the material is photographically inert.

TABLE 1

| | Seasoned bath | Seasoned bath with pumice stone |
|---|---|---|
| pH at 25° C. | 10.64 | 10.62 |
| CD2 | 2.86 g/l | 2.85 g/l |
| NaBr | 1.70 g/l | 1.70 g/l |
| $Na_2SO_3$ | 3.47 g/l | 3.43 g/l |
| Total alkalinity (10 ml) | 35.3 ml | 35.2 ml |

TABLE 2

| | Layer sensitive to red light | Layer sensitive to green light | Layer sensitive to blue light |
|---|---|---|---|
| ΔDmin | 0% | 0% | 0% |
| ΔContrast | 1.8% | 0.3% | 0.9% |
| ΔSpeed | 0% | 0.4% | 0% |

The minimum density corresponds to the density of a part of the unexposed film (support+fog).

The contrast is the slope of the straight line joining the point of density 1.00 and that corresponding to an exposure lower by 0.40 log E.

The speed is measured at 100(3-log E), E being the exposure at the point of density 1.00 above 0.

We claim:

1. Process for eliminating tars from photographic baths which comprises contacting the photographic bath containing the tars with a lipophilic device obtained by reacting a silane film-forming compounds selected from alkylchlorosilane or alkylalkoxysilane wherein the alkyl group comprises at least 3 carbon atoms with a support having an active group capable of reacting with the silane film-forming componds, and thus trapping the tars.

2. Process according to claim 1 wherein the silane film-forming compound is selected from alkylchlorosilane or alkylalkoxysilane wherein the alkyl group comprises at least 8 carbon atoms.

3. Process according to claim 1 wherein the active group is selected from acid groups or hydroxyl groups.

4. Process for eliminating tars from photographic baths which comprises contacting the photographic bath containing the tars with a lipophilic device obtained by reacting a a silane film-forming compounds selected from alkylchlorosilane or alkylalkoxysilane wherein the alkyl group comprises at least 8 carbon atoms with a support having an active group capable of reacting with the silane film-forming componds, and this trapping the tars.

5. Process according to claim 4 wherein the active group is selected from acid groups or hydroxyl groups.

6. Process for eliminating tars from photographic baths which comprises contacting the photographic bath containing tars with a lipophilic device obtained by reacting a a silane film-forming compounds selected from alkylchlorosilane or alkylalkoxysilane wherein the alkyl group comprises at least 8 carbon atoms with a support having a hydroxyl active group capable of reacting with the silane film-forming componds, and thus trapping the tars.

7. Process for eliminating tars from photographic baths which comprises contacting the photographic bath containing tars with a lipophilic device comprising a support having grafted theron an alkyl siloxane wherein the alkyl group conprises at least 3 carbon atoms, thus trapping the tars.

8. Process acording to claim 7 wherein the alkyl group comprises at least 8carbon atoms.

* * * * *